US005363770A

United States Patent [19]

Makimura et al.

[11] Patent Number: 5,363,770

[45] Date of Patent: Nov. 15, 1994

[54] DRIVE UNIT FOR TRANSPORT TROLLEY HAVING PLASTIC CENTER LINK AND DRIVE DOG COVERING FOR NOISE REDUCTION

[75] Inventors: Katsuyoshi Makimura, Osaka; Kazuo Yano, Kobe, both of Japan

[73] Assignee: Daifuku Co., Ltd., Osaka, Japan

[21] Appl. No.: 63,893

[22] Filed: May 17, 1993

[30] Foreign Application Priority Data

May 19, 1992 [JP] Japan ..... 4-125200

[51] Int. Cl.[5] ..... B61B 12/00

[52] U.S. Cl. ..... 104/172.5; 104/89; 104/172.4; 198/687

[58] Field of Search ..... 104/89, 93, 95, 172.4, 104/172.5; 105/780; 198/687, 687.1, 465.4

[56] References Cited

U.S. PATENT DOCUMENTS

| | | | |
|---|---|---|---|
| 2,411,906 | 10/1944 | Suman | 198/687 |
| 3,420,188 | 1/1969 | Dehne et al. | 104/172.4 |
| 3,926,303 | 12/1975 | McCall | 104/172.4 X |
| 4,031,829 | 6/1977 | Bell et al. | 104/172.5 X |
| 4,228,738 | 10/1980 | Forshee | 104/95 |
| 4,433,627 | 2/1984 | Forshee | 104/95 |
| 4,471,867 | 9/1984 | Forshee | 104/95 X |
| 4,484,525 | 11/1984 | Forshee et al. | 104/95 |

FOREIGN PATENT DOCUMENTS 2041864 9/1980 United Kingdom ..... 198/687

*Primary Examiner*—Robert J. Oberleitner
*Assistant Examiner*—S. Joseph Morano
*Attorney, Agent, or Firm*—Schweitzer Cornman & Gross

[57] ABSTRACT

The present invention intends to prevent generation of metallic noise when both longitudinal sides of the chain supporting trolley (22) installed to the center link (19) of the chain collide against the ends of the adjoining side links (20*a*, 20*b*, 25) when the driving chains (18) which comprise linkchains in which a center link (19) whose plane shape is an elongated ring and a pair of top and bottom side links (20*a*, 20*b*, 25) are linked alternately become loose. The present invention comprises a rib (32) installed to the center link (19) at the longitudinal center, vertically notched grooves (27*c*, 28*c*, 33), in which the rib (32) of the center link is fitted, provided to the vertical portion (27*a*, 28*a*) penetrating the center link (19) of a pair of left and right trolley units (27, 28) composing the chain supporting trolley (22) and to a plate type spacer (29) which intervenes between both vertical portions (27*a*, 28*a*) and is made of plastics, and a portion of both front and rear sides of the said plate shape spacer (29), which at least adjoins the ends of the side links (20*a*, 20*b*, 25), protruded longitudinally outward from the vertical portion (27*a*, 28*a*) of each trolley unit.

8 Claims, 9 Drawing Sheets

DRIVE UNIT FOR TRANSPORT TROLLEY HAVING PLASTIC CENTER LINK AND DRIVE DOG COVERING FOR NOISE REDUCTION

FIELD OF THE INVENTION

The present invention relates to a drive unit for propelling a transport trolley of a conveyor system.

BACKGROUND OF THE INVENTION

The type of drive unit for transport trolley with which this invention is concerned employs a driving chain formed by alternately linking a center link having an elongated annular profile, with top and bottom links attached to both ends of the center link with connecting pins. A plate shape spacer intervenes between vertical portions which penetrate the center link of both trolley units, and couplings link all of these three with each other.

The transport equipment which utilizes this kind of drive unit can be classified into two broad categories: the overhead conveyor type in which the travel route of the chain supporting trolley is located above the travel route of the transport trolley, and the floor conveyor type in which the travel route of the transport trolley is located above the travel route of the chain supporting trolley. In the overhead type of conveyor transport equipment the drive chains are hung from a chain supporting trolley. A pusher is used for the bottom side link at appropriate intervals. A chain supporting trolley is generally linked to each of the center links positioned with the pusher. A driven dog of the transport trolley is pushed by the pusher and an antirunaway piece is installed close after the pusher. This antirunaway piece is vertically rockably pivoted to enable passing of the pusher thereover. In the floor type of conveyor transport equipment, it is common to install the pusher so that it protrudes upwardly from the lower disposed drive chains or the chain supporting trolley, and the driven dog and the antirunaway piece are installed similarly to close of the overhead type conveyor but to the lower side of the transport trolley.

In the transport trolley drive unit of the above-mentioned configuration, a vertical connecting pin connects the center link of the driving chain with the top and bottom links. The vertical pin penetrates the elongated annular center link to be longitudinally rockable, causing the chain supporting trolley installed to the center link and top and bottom links located on both the front and the rear to approach each other horizontally and the opposite surfaces to collide with each other. Because these chain supporting trolleys and the links are made of metal, collision of the two results in a loud metallic noise.

The other surface of the antirunaway piece is stricken by the pusher right before the pusher impacts against, and starts to push, the driven dog. Upon contact with the pusher the antirunaway piece tilts allowing the pusher to pass thereover and then the antirunaway piece falls backward returning to its normal position. When the pusher impacts against the antirunaway piece a loud metallic noise is generated.

After the antirunaway piece is tilted forwardly by the pusher the antirunaway piece recovers its original position but then the contacted surface of the antirunaway piece collides against a tilt stopper surface on the side in which the antirunaway piece is pivoted. This results in another loud metallic noise that is similar to the noise when the pusher collides against the driven dog.

These loud metallic changing and screeching noises are very disturbing and substantially degrade working conditions in the area.

DESCRIPTION OF THE INVENTION

The present invention solves the above-mentioned problems of this type of drive units for transport trolleys. It greatly reduces the noise generated by the side of the chain supporting trolley colliding against the edge of the side link when the driving chain becomes loose.

It also reduces noises generated when an antirunaway piece slides against the pusher or the driven dog or when the antirunaway piece is tilted and also when it recovers its original position.

It also reduces the noise generated when the pusher collides with against the driven dog.

Accordingly, in a drive unit for a transport trolley for propelling a transport trolley by engagement of a pusher on a driving chain with a driven dog of the transport trolley, wherein the driving chain is supported from a chain guiding rail by chain supporting trolleys, the driving chain having center links of an elongated annular shape with an interior space, and top, bottom, and bottom pusher links each attached with connecting pins from the center links, the chain supporting trolley having right and left trolley units each with upper ends having wheels thereon, and each with lower ends for insertion into the interior space of a center link of the driving chain, a plate shaped spacer of the driving chain disposed between the right and left trolley units and bound together with fastening means, the lower ends of the right and left trolley units having recesses thereon for accommodating a center link therein, the improvement of the invention which comprises a rib extending through the interior space of the center link, an open groove each in the respective lower ends of the right and left trolley units for accommodating said rib therein, the plate shaped spacer having ends and longitudinal edges, said spacer being made of a synthetic material and having a vertical groove open to one end thereof for accommodating said rib therein, and the longitudinal edges of the spacer project outwardly from between the right and left trolley units.

The open direction of the vertical groove of the plate shaped spacer is opposite to the open direction of the open grooves in the right and left trolley units. The fastening means for interconnecting the right and left trolley units and the plate shaped spacer comprises at least two fasteners disposed respectively above and below the rib and the center link.

The invention further comprises a pivotable antirunaway piece having an upper part and a lower part. The antirunaway piece is mounted from the transport trolley or the driving chain, and has an upper contact face on the upper part. The antirunaway piece is pivotable for permitting passing of the pusher or the driven dog. A first cushioning member of a synthetic material covering said upper contact face adapted to contact the pusher or the driven dog.

The first cushioning member has a stem with a snap retaining shoulder in a free end with a snap retaining shoulder thereon. A cavity is provided in the antirunaway piece for accommodating the first cushioning member therein, and a hole is provided in the antirunaway piece for locking the stem therein.

Provision is made for cushioned contact between the lower part of the antirunaway piece and a correspondingly located part of the transport trolley, wherein that provision comprises either (i) that the antirunaway piece has a second cushioning member mounted from the lower part, or (ii) the correspondingly located part of the transport trolley has a cushioning member.

Either the second cushioning member or the cushioning member of the correspondingly located part, has a stem with a snap retaining shoulder in a free end with an snap retaining shoulder thereon. A cavity is provided either in the lower part of the antirunaway piece, or in the correspondingly located part, for accommodating the first cushioning member, or the cushioning member therein. A hole is provided in the part with the recess for locking the stem therein.

The pusher on the bottom pusher link, or the driven dog is adapted to contact the pusher that has a cushioning member for cushioning contact between the pusher and the driven dog.

The cushioning member is a hollow, tapering cylindrical body of a synthetic material and is applied over the pusher.

DESCRIPTION OF THE DRAWING

The invention is described in detail with reference being had to the drawing wherein.

DETAILED DESCRIPTION OF THE INVENTION

In the described and illustrated embodiments of the invention the overhead type of conveyor is shown with only the pusher being installed on the driving chain side. A driven dog and an antirunaway piece are installed on the transport trolley side. However, as explained earlier, the present invention can also be embodied in the floor type of conveyor in which the transport trolley is located above the driving chains. It is further possible to embody the present invention by installing a pusher and an antirunaway piece located before the pusher on the driving chain side and only a driven dog on the transport trolley side.

Figure 1:
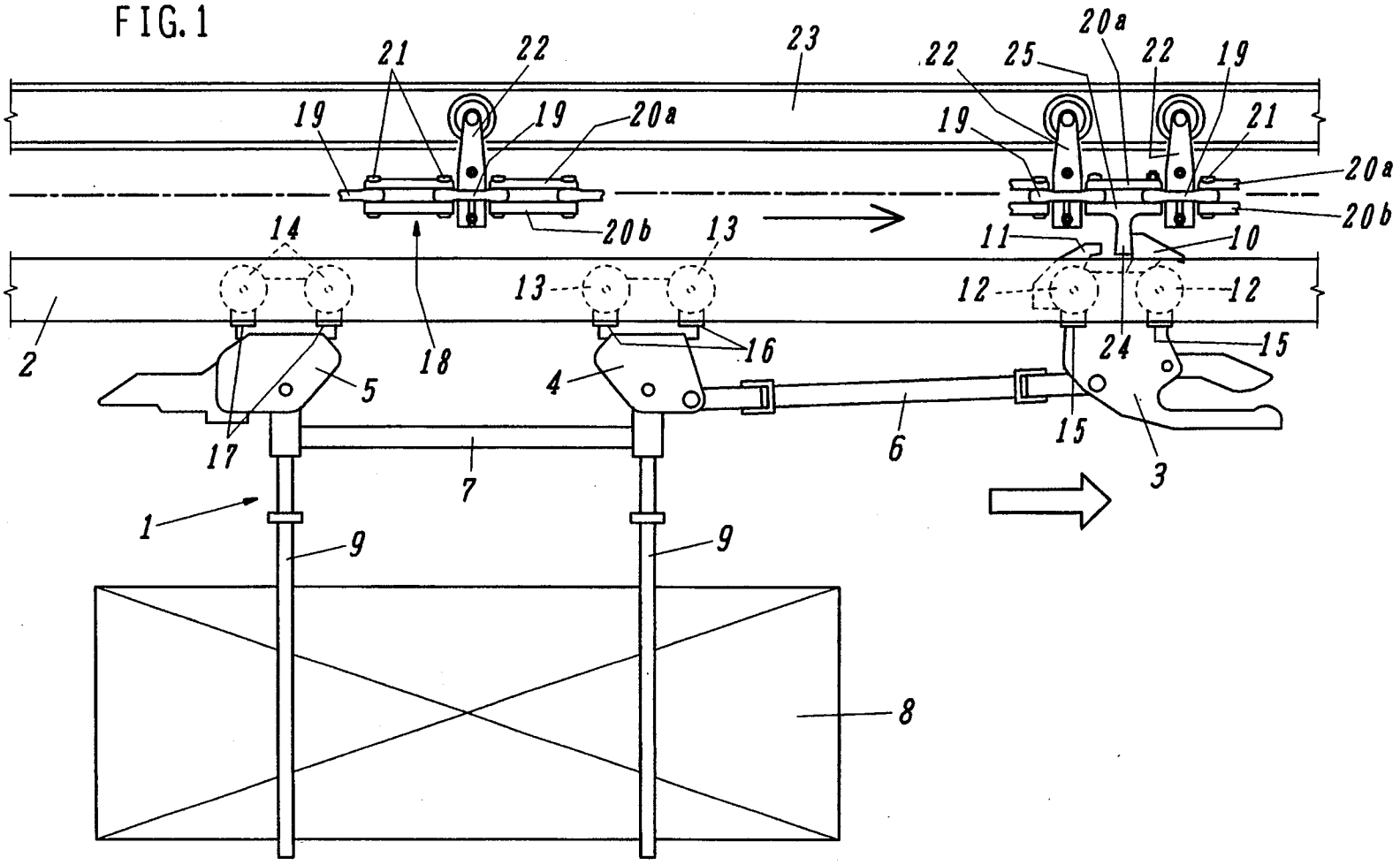
FIG. 1 is a side elevational view of the entire transport trolley drive unit of the present invention.

In the embodiment of the present invention shown in FIG. 1 transport carriage 1 is guided by a pair of parallel disposed guide rails 2, and connects front, intermediate, and rear transport trolleys 3, 4, and 5 to each other with load bars 6 and 7 and mounts load hangers 9 supporting a conveyed load 8 from the intermediate transport trolley 4 and the rear transport trolley 5. A driven dog 10 is protrudingly mounted on the upper front part of the front transport trolley 3, an antirunaway piece 11 is protrudingly mounted on the upper rear part of the front transport trolley 3. Pairs of right and left wheels of sets of front and rear wheels are pivotably mounted from the front transport trolley 3. Similarly, a set of wheels 13 are mounted from the intermediate transport trolley 4, and a set of wheels 14 are mounted from the rear transport trolley 5. The wheels of the sets 12, 13, and 14 are adapted to run within the parallel disposed guide rails 2. A pair of fore and aft vertical shaft clamper rollers 15, 16, and 17 located between the parallel guide rails 2 are pivotably mounted respectively from the front, intermediate and rear transport trolleys 3, 4, and 5. A driving chain is employed in which a center link 19 is connected to top and bottom side links **20*a*, 20*b* with a vertical connecting pin 21. A chain supporting trolley 22 is connected to a center link 19 at predetermined intervals along the length of the driving chain 18, and is movably supported from a chain guiding rail 23**.

Periodically, special bottom links are provided in the driving chain 18. These have in integral pusher 24 protruding downwardly and the chain supporting trolley 22 is connected to the center links 19 in front and in rear of the side link 25.

Figure 2:
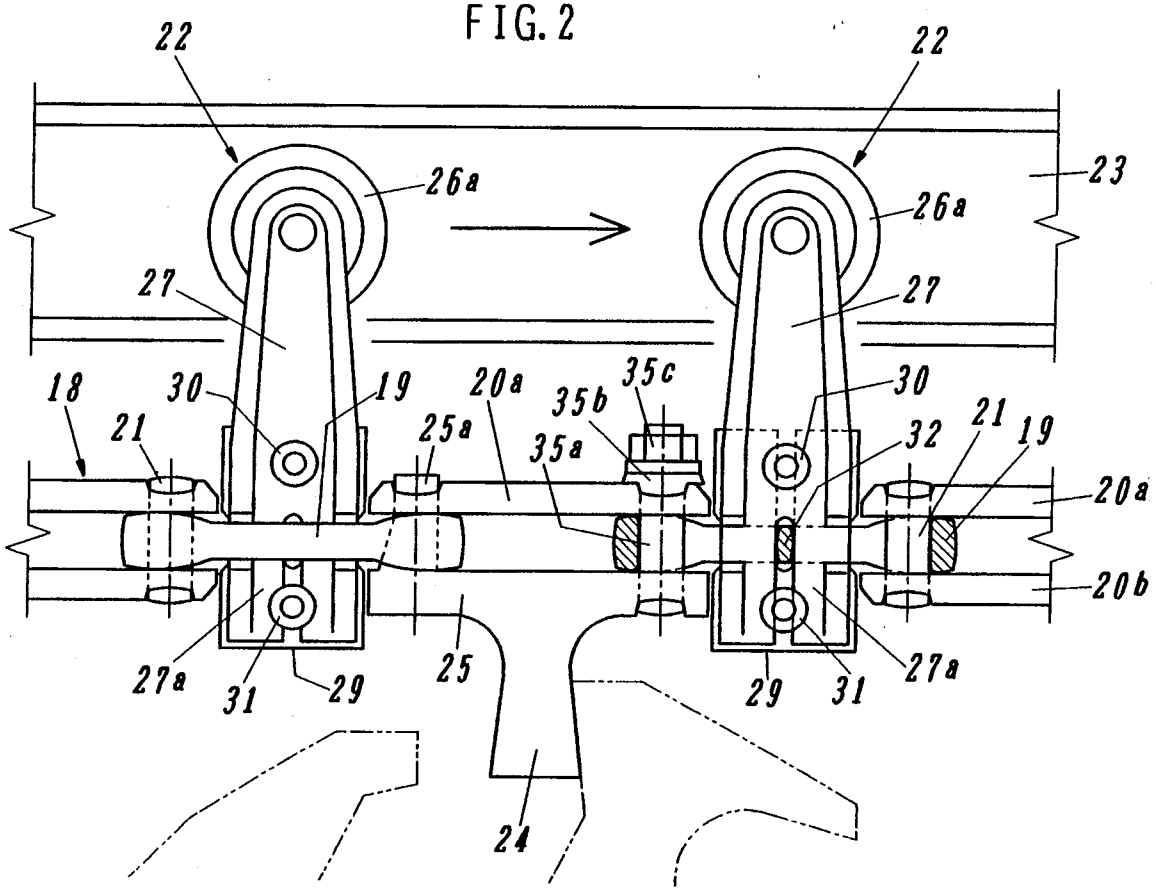
FIG. 2 is a partial side elevational view showing an essential part of a first embodiment.
Figure 3:
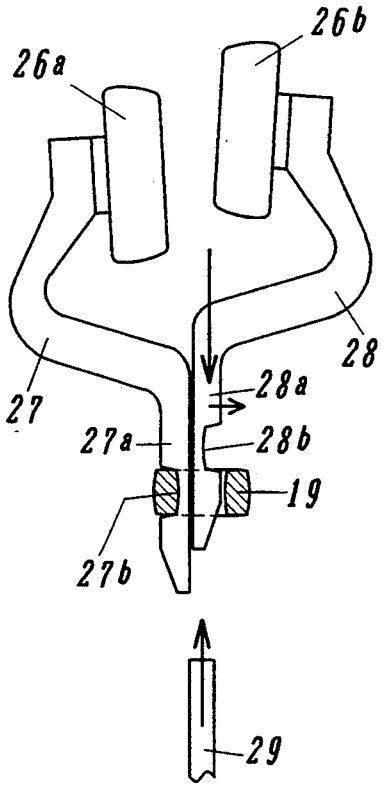
FIG. 3 is a partial longitudinal front elevational view showing the assembly procedure of the trolley unit with respect to the center link.
Figure 4:
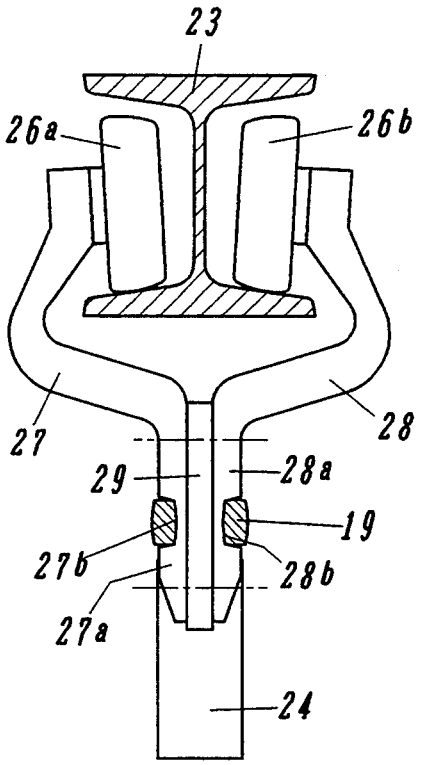
FIG. 4 is a partial longitudinal front elevational view of in the direction of the arrow in FIG. 2.

As shown in FIGS. 2–4 the chain supporting trolley 22 is comprised of right and left trolley units 27, 28 having respectively vertical portions **27*a* and 28*a*. Wheels 26*a*, 26*b* are pivotably mounted respectively from these trolley units and a plate shaped spacer 29 is intermediately installed between the vertical portions 27*a*, 28*a* of the two trolley units 27, 28. The bolt and nut combinations 30, 31 in each trolley 22 bond trolley units 27 and 28 and the spacers 29 into a single unit. The chain guiding rail 23 has a single cross-sectional profile as shown in FIG. 4 and the vertical H-shaped right and left wheels 26*a*, 26*b* of the chain supporting trolley 22 fit into the grooves on each side of the rail 23**.

The center link 19 has an elongated annular profile. On the outer side of each vertical portion **27*a*, 28*a* of a chain supporting trolley 22, respective indentations 27*b*, 28*b* are provided, and the center link 19 fits into these indentations. More specifically, a reinforcing rib protrudingly installed on both front and rear sides outside each trolley unit 27, 28 is notched to form the indentations 27***b* and 28*b*. Therefore, as shown in FIG. 3, first the vertical portion 27*a* of the trolley unit 27 is inserted into one side of the center link 19, the center link 19 is fitted into the indentation 27*b*, and then the vertical portion 28*a* of the trolley unit 28 is inserted into the other side of the center link 19. Next the other side of the center link 19 is filled into the indentation and the plate shape spacer 29 is inserted between vertical portions 27*a*, 28*a* of the trolley units. Then the vertical portions 27*a*, 28*a* of both the trolley units and place shape spacer 29 between them are linked with bolt and nut attachments 30, 31 at the top and bottom of the center link 19, and this concludes the assembly of chain supporting trolley 22 and its installation to the center link 19 of the driving chain 18.

As shown in FIG. 2, 5–7 a rib 32 is formed in the center link 19, at is elongated side so that it perpendicularly divides the interior space of the link into two parts. A vertical notched groove 27*c*, 28*c* is formed respectively in each vertical portion 27*a* and 28*a* of each trolley unit 27 and 28. The rib 32 is fitted from the lower side center position into the grooves 27*c* and 28*c*. A vertical groove 33 is formed from the upper side center of the plate shape spacer 29 and the rib 32 is fitted into the groove 33. The vertical portions 27*a* and 28*a* of the trolley units are inserted downwardly to the center link 19, the plate shape spacer 29 is inserted upwardly between them.

The width of the vertical notched groove 33 of the plate shape spacer 29 can be made slightly narrower than the thickness of the rib 32 to bring both sides of the notched groove 33 in contact with two longitudinal sides of the rib 32. Bolt holes 27*d*, 27*e*, 28*d*, 28*e*, 34*a*, 34*b* are provided respectively in vertical portions 27*a*, 28*a* and the plate shape spacer 29 for insertion of the bolt and nut combinations 30 and 31 at the top and the bottom. Bolt holes 27*e*, 28*e*, 24*a* overlap the notched grooves 27*c* , 28*c*, 33.

Figure 8:
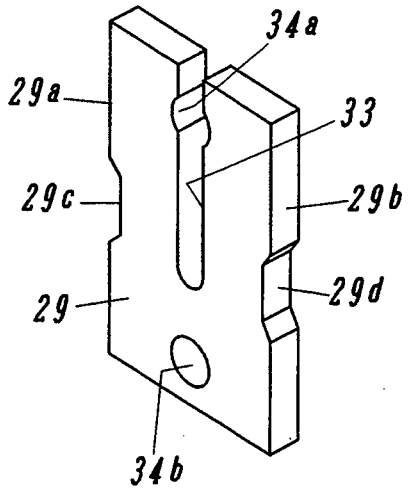
FIG. 8 is a perspective view of a plate shape spacer.

The plate shaped spacer 29 is suitably formed from a plastic such as nylon 6. The longitudinal dimension of the spacer is greater than that of the vertical portions 27*a* and 28*a* so that the longitudinal edges 29*a*, 29*b* of the plate shape spacer 29 protrude outwardly from between the vertical portions 27*a* and 28*a*. Because the driving chain 18 shown in this embodiment is designed to have narrow intervals (chain link pitch) between connecting pins 21, the longitudinal dimension of the vertical space within the center link 19 (portions shown with 19*a*, 19*b* in FIG. 7) remaining on both the front and the rear of the chain supporting trolley 22 is short when the chain supporting trolley 22 is attached to the center link 19. Consequently, letting the edges 29*a*, 29*b* of the plate shaped spacer 29 protrude longitudinally from between the vertical portion 27*a*, 28*a* throughout the entire vertical area, prevents the vertical connecting pin 21 with a T-shaped head portion on both ends as shown with broken lines in FIG. 7, from passing into the vertical space 19*a*, 19*b* of the center link 19. For that reason, as also shown in FIG. 8, the notched concave portions 29*c*, 29*d* are provided formed at the positions adjoining the vertical spaces 19*a*, 19*b* of the center link 19 of the front and rear edges 29*a*, 29*b* of the plate shape spacer 29.

When the chain supporting trolley 22 is installed through the center link 19 a pair of top and bottom side links 20*a*, 20*b* or upper side link 20*a* and lower side link with a pusher 25 are linked to the ends of the center link 19 which protrude to the front and rear of the said chain supporting trolley 22. As shown in FIG. 2, the center link 19 and top and bottom side links 20*a*, 20*b* are linked with a connecting pin 21 with a T-letter head on both ends as described above, and when the upper side link 20*a* and lower side link 25 with a pusher are linked to the center link 19, a T-shaped fixing pin 25*a* which is protrudingly installed upward from one end of the lower side link 25 with a pusher, a T-shaped bolt 35*a* which is inserted upwardly through the hole on the other end of the lower side link 25 with a pusher, and a washer 35*b* and a nut 35*c* are used to affix the bolt 35*a* in place.

Figure 5:
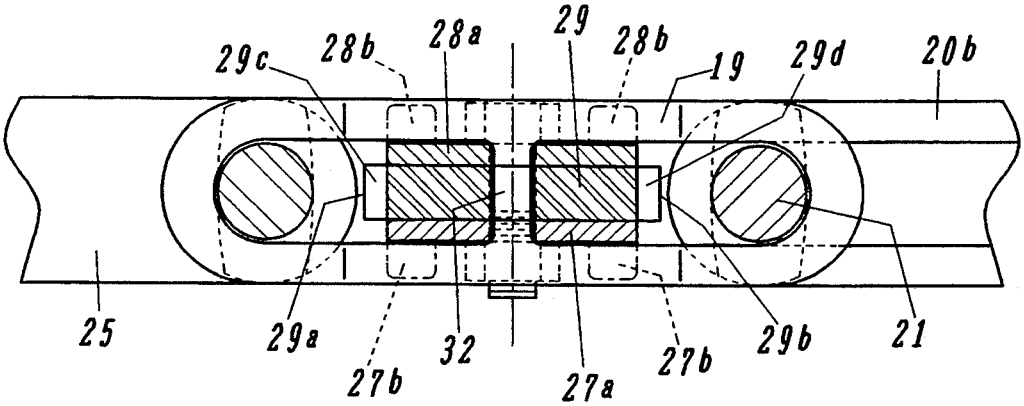
FIG. 5 is a cross-sectional plan view showing the connecting structure between the center link and the chain supporting trolley.
Figure 6:
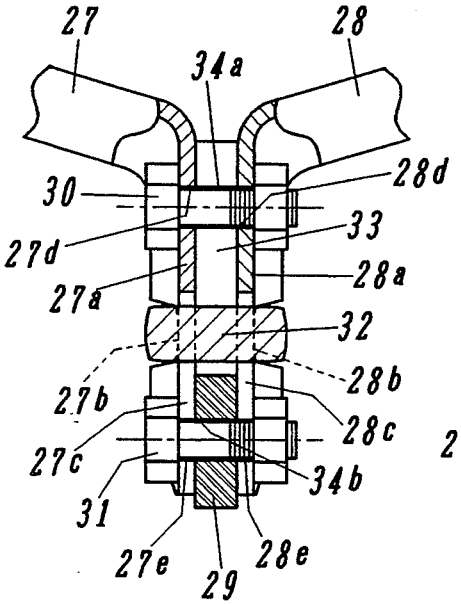
FIG. 6 is a longitudinal front view of the same as shown in FIG. 5.
Figure 7:
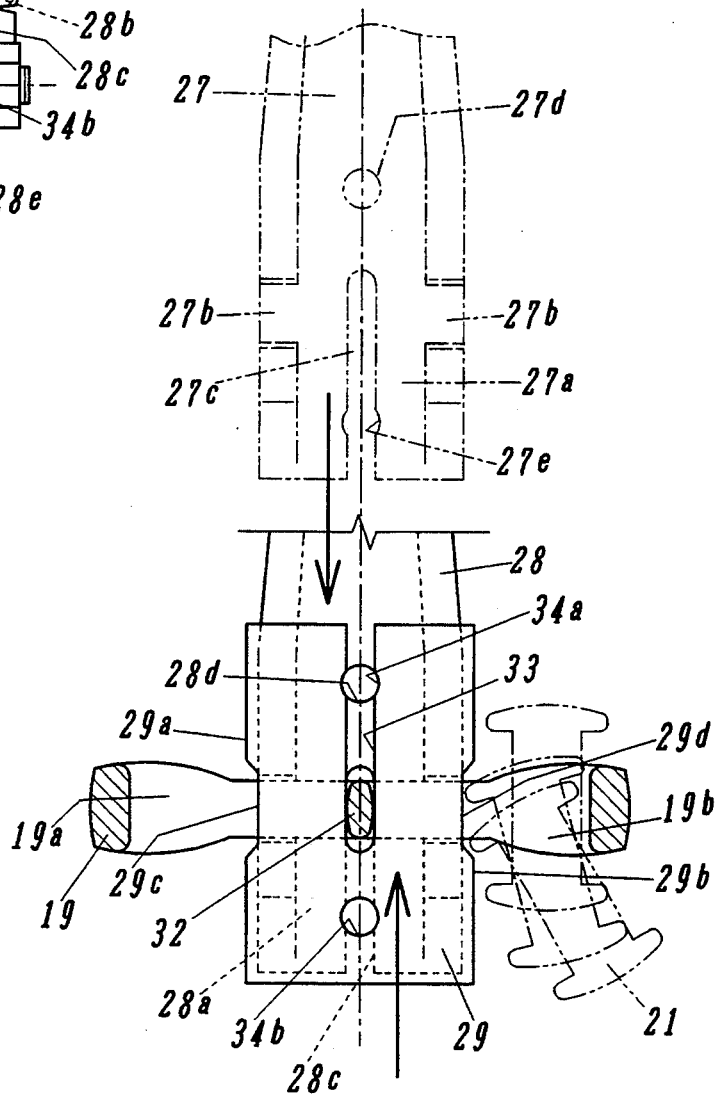
FIG. 7 is a partial longitudinal side view showing the center link fitted with trolley unit and plate shape spacer to one side.

As shown in FIGS. 2 and 5, in the assembled driving chain 18, the ends of the side links 20*a*, 20*b* located in the front and in the rear of the chain supporting trolley 22 and the ends of the upper side link 20*a* and the pusher equipped lower side link 25 adjoin the sides 29*a*, 29*b* in the longitudinal direction of the plate shape spacer 29 which protrude in the longitudinal direction from the vertical portions 27*a*, 28*a* of the trolley 22. Consequently, when the driving chain 18 becomes loose and the side links 20*a*, 20*b*, 25 collide against both protruding sides 29*a*, 29*b* of the plastic plate shape spacer 29 and no metallic clanking noise is generated.

Figure 9:
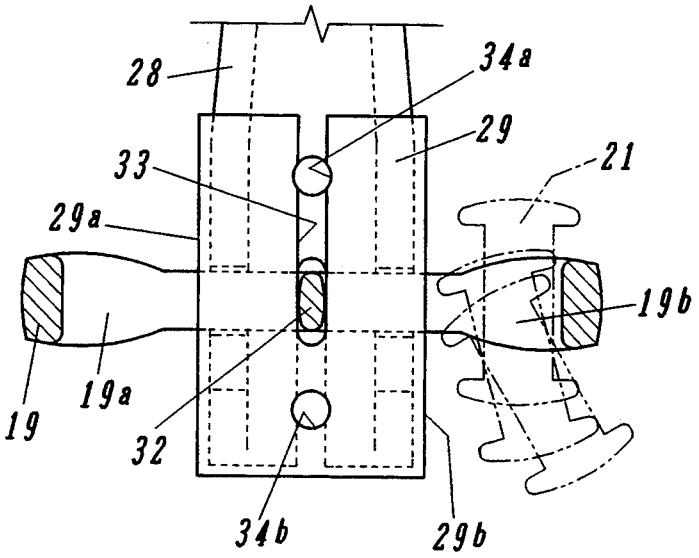
FIG. 9 is a figure like in FIG. 7, showing a partial longitudinal side view illustrating a modified embodiment of the plate shape spacer.

If the driven chain 18 has a wide interval (chain link pitch) between connecting pins 21, as shown in FIG. 9, the length in the longitudinal direction of the vertical free spaces 19*a* and 19*b* in the link remaining in the front and rear of the said chain supporting trolley 22 becomes longer when the chain supporting trolley 22 is installed to the center link 19. This enables the smooth insertion of the T-shaped connecting pin 21 through the vertical spaces 19*a*, 19*b* in the link 19 without the need to provide a notched concave portions 29*c* and 29*d* to front and rear sides 29*a*, 29*b* of the plate shape spacer 29.

Even with a short pitch driving chain 18 which enables the insertion of the T-shaped connecting pin 21 though the vertical spaces 19*a* and 19 of the center link 19 only when the notched concave portions 29*c*, 29*d* are provided to both front and rear sides 29*a*, 29*b*, of the plate shape spacer, it may not be the plate shape spacer, it may not be necessary to provide notched concave portions 29*c*, 29*d* to the plate shape spacer 29. This applies only if the chain supporting trolley 22 is attached to the center link 19 with side links 20*a*, 20*b*, 25 connected on both ends.

As shown in FIG. 1, the pusher 24 propels a transport carriage 1 by pushing the driven dog 10, but the antirunaway piece 11 which is located in the longitudinal direction behind the pusher 24, prevents the transport carriage 1 from going forward at a speed higher than that of the pusher 24 of the driving chain 18 by retaining the pusher 24 between the driven dog 10 and the antirunaway piece 11. This can be especially important when, for example, when the route of travel is downhill.

Figure 10:
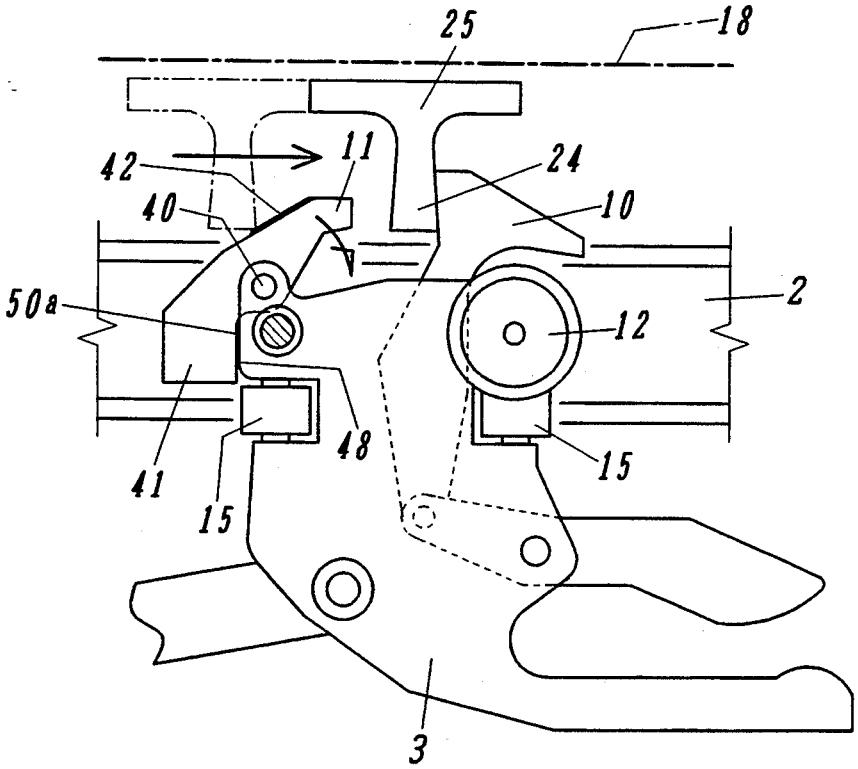
FIG. 10 is a partial side elevational view of an essential part of a rockable antirunaway piece mounting.
Figure 11:
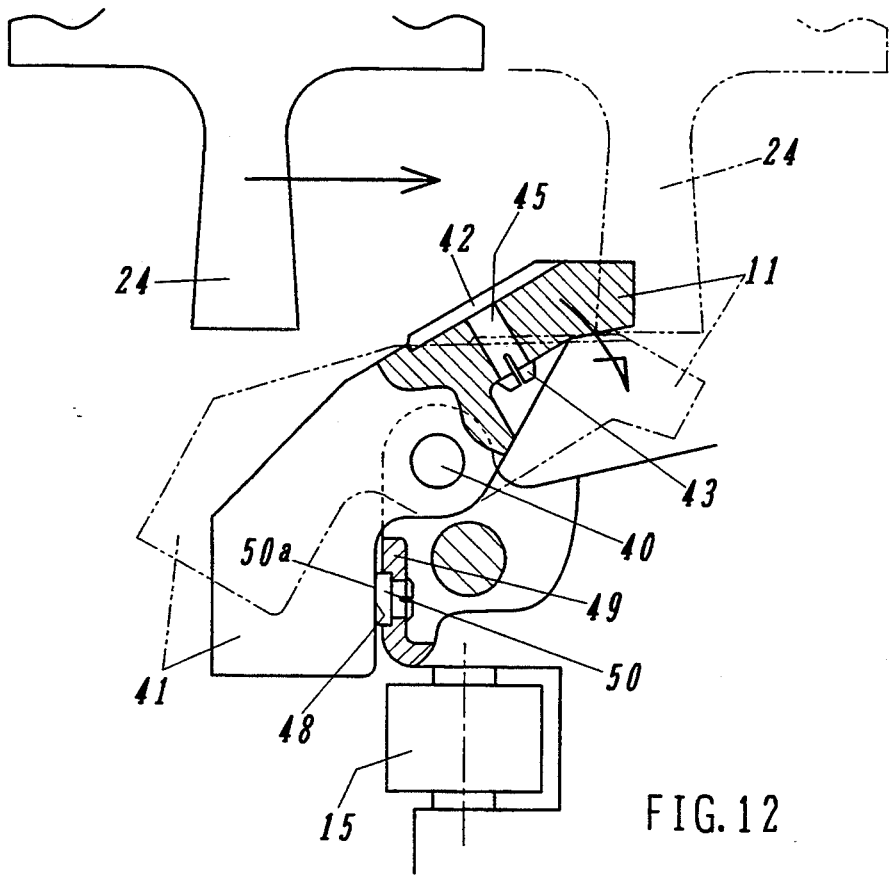
FIG. 11 is a partial longitudinal side elevational view showing an enlarged part of FIG. 10.

The antirunaway piece 11 is vertically rockably pivoted from the transport trolley 3 with a spindle 40 as shown in FIGS. 10 and 11, and is held in an upright position, as illustrated, by gravity due to the weight of an idle end 41 hanging down in the rear of the antirunaway piece 11. A plastic cushioning member 42, such as a nylon 6, is installed on a contact face of the antirunaway piece 11 which is contacted by the pusher 24 when the pusher 24 overtakes and passes the antirunaway piece 11.

Figure 12:
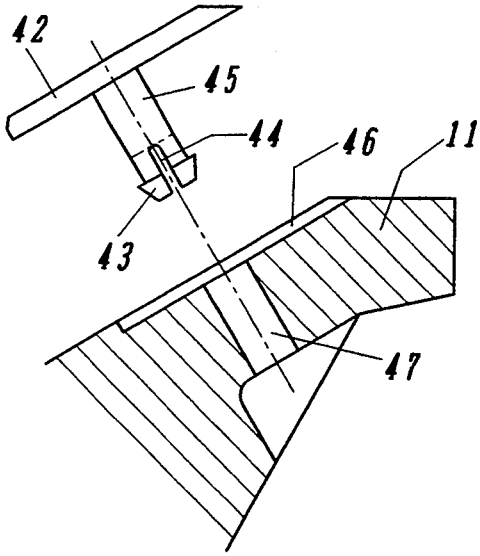
FIG. 12 is a longitudinal cross sectional side view of a cushioning member mounting portion of an antirunaway piece, and an elevational side view of cushioning member before installation.
Figure 13:
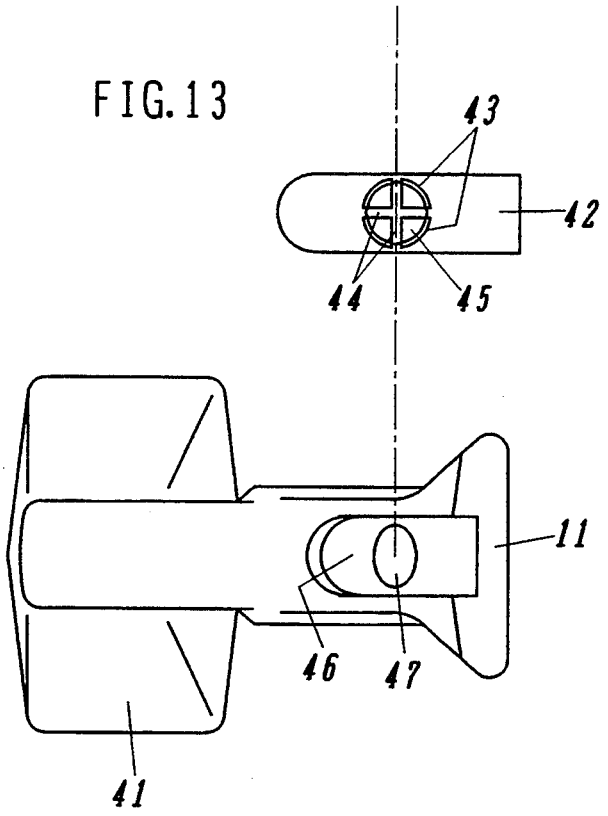
FIG. 13 is a plan elevational view of a cushioning member mounting portion of an antirunaway piece, and a bottom elevational view of cushioning member before installation.

As shown in FIGS. 12 and 13 the cushioning member 42 is a long strip snapped into the back of the antirunaway piece 11. The T-shaped cushioning member 42 has a stem 45 with a longitudinal slot 44 forming two elastic ends on the end of the stem. Snap retaining shoulders 43 are formed in the elastic ends so that upon insertion of the stem 45 into a hole 47 in the antirunaway piece 11 anchored within the antirunaway piece. A cavity 46 is provided in the rear surface of the antirunaway piece 11, to permit the nesting of the cross piece of the T-shaped plastic cushioning member within the cavity with its top surface being substantially flush with the adjacent surfaces of the antirunaway piece.

With the presence of the said cushioning member 42, when the pusher 24 collides against the back of the antirunaway piece 11 and the pusher passes over it by tilting the antirunaway piece 11 forward, the pusher 24 glides over and in contact with the cushioning member 42 without the occurrence of a metallic clanking noise.

Figure 14:
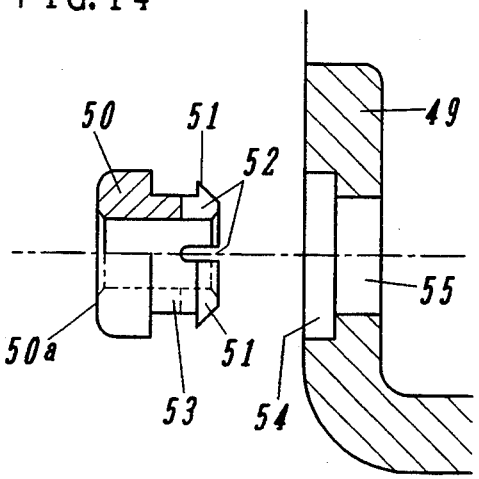
FIG. 14 is a longitudinal cross sectional side view of a cushioning member mounting portion on the stopper surface of the transport trolley, and a partial longitudinal side view of cushioning member before installation.

As shown in FIGS. 11 and 14 when the antirunaway piece 11 is not tilted forward, but is in its upright position, its idle and 41 contacts a surface 48 in a vertical rear wall 49 of the mounting of the rear wheel 12 of the transport trolley 3. A cushioning member 50 with a protruding abutment cushioning surface 50*a* is retained within this surface 48 somewhat similarly to the retention of the plastic cushioning member 42.

The cushioning member 50 is a ring shape formed from plastic such as a fluoro rubber, and has a round head with a cushioning surface 50*a*. A circular shaped retaining shoulder 51 at the end of a stem 53 containing a slot 52 assures the retention of the cushioning member within a recessed surface portion 54 and through a hole 55 within the wall 49.

With the presence of the said cushioning member 50, when the antirunaway piece 11 which is stricken by the pusher 24, then tilts forward as the pusher passes thereover, it will recover its original position under the effect of gravity. The idle and 41 will abut against the cushioning stopper surface 50*a* of the cushioning member 50. Due to the cushioning effect no metallic clanking noise will be generated, since no metal to metal contact takes place. If desired, the cushioning member 50 can be installed within the idle end 41 of the antirunaway piece 11 instead of in the wall 49, or in both the idle end 41 of the antirunaway piece 11 and the rear vertical wall 49 in the transport trolley 3.

Figure 15:
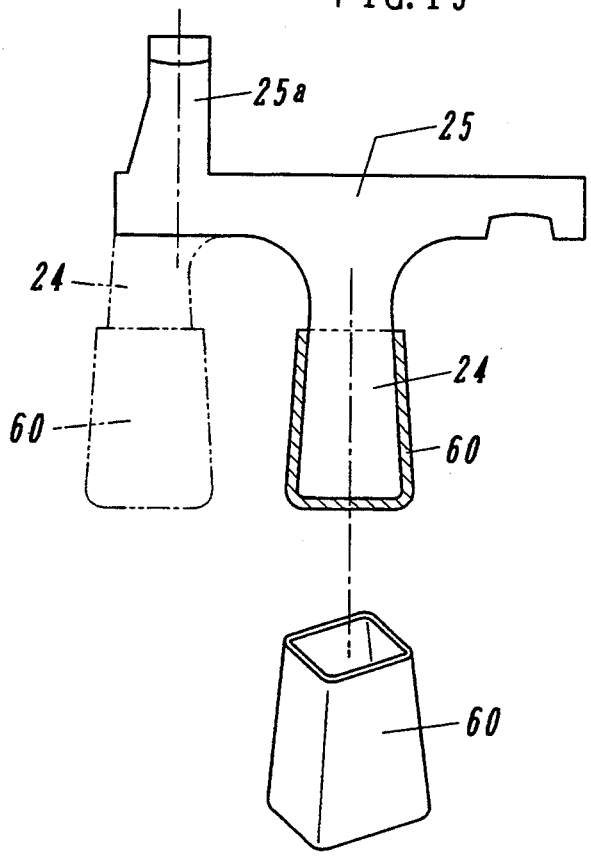
FIG. 15 is a partial longitudinal side view showing a part of another perspective of a cushioning member for a pusher before installation.

As shown, for example, in FIG. 2, the sides in the longitudinal direction of the pusher 24 which is downwardly protrudingly mounted from the driving chain 18, are slightly slanted so that the width of the pusher in the longitudinal direction increases toward its lower end. This is to prevent the generation of downward pressure on the driven dog 10 and the transport trolley 3. As shown in FIG. 15 a bottomed cylindrical plastic cushioning member 60 can be fitted over and attached to the pusher 24.

The cushioning member 60 is formed from a thermoplastic material and is applied over the pusher 24 by expanding the opening of the heated and softened cushioning member 60 and fitted if over the pusher 24. The cooled and hardened cushioning member 60 will closely fit to the pusher 24. A cushioning member 60 with proper elasticity can also be applied over the pusher 24 without heating. One can also employ a heat shrinkable plastic material and closely fit such a cushioning member 60 over the pusher 24 by heating. Due to the outward slanting sidewalls of the pusher 24 the cushioning member 60 fitted over and fixed to the pusher will not unexpectedly come off even if no adhesive is used.

The pusher 24 need not be located at the lengthwise center of the side link 25 but can also be located at the end of the side to which the fixing pin 25*a* for linkage is protrudably installed, as shown in broken lines in FIG. 15.

Figure 16:
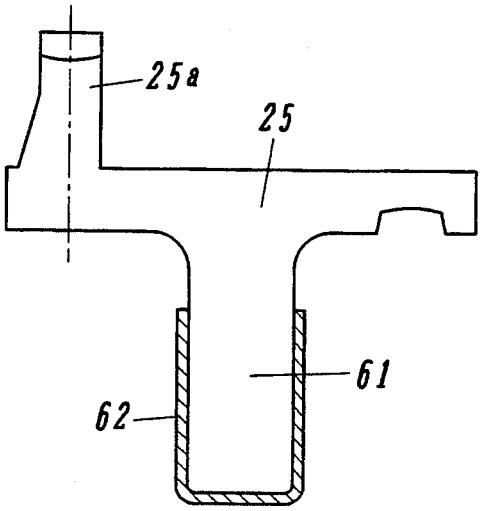
FIG. 16 is a partial longitudinal side vie showing a modified example of the pusher cushioning.

As further shown in FIG. 16, when an alternatively shaped straight pusher 61 is used, which is a prism with parallel longitudinal sides, an adhesive is required to attach a straight walled cushioning member 62 to the straight pusher 61.

The cushioning members 60, 62 are both effective to suppress noise generated both when the pushers 24 and 61 abut against and tilt the antirunaway piece 11 shown in FIG. 10, and when the pushers 24 and 61 impact upon the driven dog 10. Because these cushioning members 60, 62 cover both the bottom and rear of the pushers 24, 61, it is possible effectively to suppress both the screeching noise of the gliding contact generated when the bottom surface of the pushers 24, 61 slides in contact with the rear of the tilted forward antirunaway piece 11, and the sound of impact when the antirunaway piece 11 from behind abuts against the rear of the pushers 24, 61. Therefore, when the pusher is cushioned as shown in FIGS. 15 or 16, the cushioning member 42 of the antirunaway piece 11 can be eliminated, or both forms of cushioning can be employed together.

It can also affix to the driven dog 10 an appropriate cushioning member, depending on the form of the driven dog.

What is claimed is:

1. In a drive for a transport carriage for propelling a transport trolley by engagement of a pusher on a driving chain with a driven dog of the transport trolley, wherein the driving chain is supported from a chain guiding rail by chain supporting trolleys, the driving chain having center links of an elongated annular shape with an interior space, and top, bottom, and bottom pusher links each attached with connecting pins from the center links, the chain supporting trolley having right and left trolley units each with upper ends having wheels thereon, and each with lower ends for insertion into the interior space of one of said center links of the driving chain, a plate shaped spacer of the driving chain disposed between the right and left trolley units and bound together with fastening means, the lower ends of the right and left trolley units having recesses thereon for accommodating the one center link therein, the improvement which comprises a rib extending through the interior space of the center link, an open groove each in the respective lower ends of the right and left trolley units for accommodating said rib therein, the plate shaped spacer having ends and longitudinal edges, said spacer being made of a synthetic material and having a vertical groove open to one end thereof for accommodating said rib therein, and the longitudinal edges of the spacer project outwardly from between the right and left trolley units.

2. The drive of claim 1, wherein the open direction of said vertical groove of said plate shaped spacer is opposite to the open direction of said open grooves in said right and left trolley units, and wherein the fastening means for interconnecting the right and left trolley units and the plate shaped spacer comprises at least two fasteners disposed respectively above and below said rib and the center link.

3. The drive of claim 1, further comprising a pivotable antirunaway piece having an upper part and a lower part, said antirunaway piece being mounted from the transport trolley or the driving chain, said antirunaway piece having an upper contact face on said upper part, said antirunaway piece being pivotable for permitting passing of the pusher or the driven dog, and a first cushioning member of a synthetic material covering said upper contact face adapted to contact the pusher or the driven dog.

4. The drive of claim 3, wherein said first cushioning member has a stem with a snap retaining shoulder in a free end with a snap retaining shoulder thereon, a cavity in said antirunaway piece for accommodating said first cushioning member therein, and a hole in said antirunaway piece for locking said stem therein.

5. The drive of claim 3, wherein a provision is provided for cushioned contact between said lower part of said antirunaway piece and a correspondingly located part of the transport trolley, wherein said provision comprises either (i) said antirunaway piece having a second cushioning member mounted from said lower part, or (ii) said correspondingly located part of the transport trolley having a cushioning member.

6. The drive of claim 5, wherein either said second cushioning member or said cushioning member of said correspondingly located part, has a stem with a snap retaining shoulder in a free end with a snap retaining shoulder thereon, and a cavity either in said lower part of said antirunaway piece or in said correspondingly located part, for accommodating said first cushioning member or said cushioning member therein, and a hole in said part with said recess for locking said stem therein.

7. The drive of claim 3, wherein the pusher on the bottom pusher link or the driven dog that is adapted to contact the pusher has a cushioning member for cushioning contact between the pusher and the driven dog.

8. The drive of claim 7, wherein said cushioning member is a hollow, tapering cylindrical body of a synthetic material and is applied over the pusher.

* * * * *